US005893354A

United States Patent [19]

Detweiler et al.

[11] Patent Number: 5,893,354

[45] Date of Patent: Apr. 13, 1999

[54] METHOD OF CONTROLLING FUEL VAPOR CANISTER PURGE FLOW AND VAPOR MANAGEMENT VALVE THEREFOR

[75] Inventors: Charles A. Detweiler, Durand; Daniel L. DeLand, Davison; Gerrit V. Beneker, Algonac, all of Mich.

[73] Assignee: Eaton Corporation, Cleveland, Ohio

[21] Appl. No.: 09/154,117

[22] Filed: Sep. 16, 1998

[51] Int. Cl.[6] ..... F02M 37/04

[52] U.S. Cl. ..... 123/520; 123/458; 123/516

[58] Field of Search ..... 123/520, 521, 123/518, 519, 516, 458

[56] References Cited

U.S. PATENT DOCUMENTS

| | | | |
|---|---|---|---|
| 5,188,141 | 2/1993 | Cook | 123/520 |
| 5,277,167 | 1/1994 | DeLand et al. | 123/518 |
| 5,284,121 | 2/1994 | Abe | 123/520 |
| 5,390,644 | 2/1995 | Nunogaki | 123/520 |
| 5,460,137 | 10/1995 | Zabek | 123/520 |
| 5,630,403 | 5/1997 | Van Kampen | 123/520 |
| 5,632,242 | 5/1997 | Harde | 123/520 |
| 5,749,349 | 5/1998 | Detweiler | 123/520 |

*Primary Examiner*—Carl S. Miller

*Attorney, Agent, or Firm*—Roger A. Johnston

[57] ABSTRACT

A fuel vapor management valve or VMV having an electrically operated vent valve for controlling atmospheric bleed flow to a vacuum signal pressure chamber. The pressure in the signal pressure chamber controls the differential pressure acting on opposite sides of a diaphragm which moves a valve member for regulating fuel vapor purge flow from a canister to the engine intake manifold. Vacuum is applied to the signal pressure chamber through restrictive passages in a connector which prevent sonic flow choking. In one embodiment two orifices are spaced fluidically in series. In another embodiment fluidically parallel laminar flow passages are provided in an element comprising a porous filter preferably formed of fibrous material or sintered metal. In another embodiment, the laminar flow element is disposed fluidically in series with a flow restricting orifice.

11 Claims, 6 Drawing Sheets

METHOD OF CONTROLLING FUEL VAPOR CANISTER PURGE FLOW AND VAPOR MANAGEMENT VALVE THEREFOR

MICROFICHE APPENDIX

Not Applicable

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to devices of the type known as vapor management valves (VMV) which are employed for controlling purge flow of fuel tank vapor from a storage canister to the intake manifold of an internal combustion engine. Such devices are employed in light motor vehicles where evaporation of tank fuel is prevented in the engine off condition by collection of the fuel vapors in a storage canister, typically of the type containing adsorbent granular charcoal.

Known VMVs provide an electrically operated bleed valve (EVR) for bleeding atmospheric air to a signal pressure chamber supplied with intake manifold vacuum for providing a vacuum control signal to one side of a pressure responsive diaphragm. The diaphragm operates a regulator valve member for controlling vapor flow between an inlet connected to the vapor storage canister and an outlet connected to the engine intake manifold. The diaphragm is preloaded by a spring to bias the diaphragm valve member closed preventing vapor flow to the engine manifold until a predetermined pressure differential is experienced by the diaphragm. An example of such a known VMV is that shown and described in U.S. Pat. No. 5,277,167.

Referring to FIG. 1, the known valve assembly indicated generally at 1 has an EVR indicated generally at 2 which controls atmospheric vent flow through a filter 5 and coil passage 3 to an outlet passage 4 which supplies air flow through an inlet passage 6 of a vacuum pressure signal chamber 8 which is supplied with engine manifold vacuum through a connector 10 and a single bleed orifice 12.

The pressure in chamber 8 is applied to one side of a pressure responsive diaphragm 14 which moves a regulator valve member 16 with respect to a valve seat 17 for controlling flow between vacuum connector 18 connected to the engine intake manifold and a fuel vapor purge inlet connector 20 connected to a fuel vapor canister 22 which is connected to a fuel tank 24. Diaphragm 14 is preloaded by a spring 26 to prevent opening of the valve 19 until a predetermined pressure differential exists across the diaphragm 14 in a manner well known in the art.

In the aforesaid known type of VMV, it has been found that the vacuum flow rate out of the vacuum pressure signal chamber increases with increasing engine manifold vacuum. At high engine manifold vacuum levels (reduced manifold absolute pressure), when a critical pressure ratio has been reached across the flow restricting orifice provided in the vacuum signal port, sonic flow choking or limiting occurs in the port thereby preventing further increases in flow with increasing engine manifold vacuum. For proper purge flow, it has been desired to provide a VMV having the properties that the atmospheric bleed flow increases with increasing vacuum (decreasing manifold absolute pressure) throughout the range of manifold pressures experienced during engine operation without the occurrence of sonic flow choking.

Where that engine throttle is closed suddenly or rapidly i.e., a condition referred to as "tip-out", the sudden large increase in manifold vacuum (decrease in manifold absolute pressure) causes sonic flow choking to occur at the vacuum restricting orifice; and, vacuum bleed flow no longer tracks engine manifold vacuum levels. Thus, it has long been desired to find a way or means of neutralizing the effects of "tip-out" on VMV control of fuel vapor flow to the engine intake manifold.

BRIEF SUMMARY OF THE INVENTION

It is an object of the present invention to provide an electrically operated fuel vapor management valve for an internal combustion engine which provides vacuum bleed flow through the control signal pressure chamber that increases with increases in engine manifold vacuum (decrease in manifold absolute pressure) throughout the range of manifold vacuum encountered during engine operation and prevents the occurrence of sonic flow choking in the bleed flow restricting orifice.

The present invention provides a VMV having an electrically operated bleed valve or EVR controlling atmospheric vent flow to a vacuum signal pressure chamber which controls the pressure on one side of a diaphragm for operating a purge flow regulator valve. The vacuum signal to the vacuum signal pressure chamber is supplied vacuum through a plurality of flow restricting passages in the connector and which restrict flow but prevent the occurrence of sonic flow choking. In one embodiment, a pair of restricting orifices are disposed in spaced relationship fluidically in series in the vacuum signal port connection; and, in another embodiment a laminar flow element comprising plurality of laminar flow passages are provided fluidically in parallel in the vacuum signal port to the control pressure chamber for the diaphragm. Porous sintered metal or fibrous material may be employed for the latter parallel passages. In a further embodiment a single restrictive orifice is disposed fluidically in series with a laminar flow element.

DETAILED DESCRIPTION OF THE INVENTION

Figure 1:
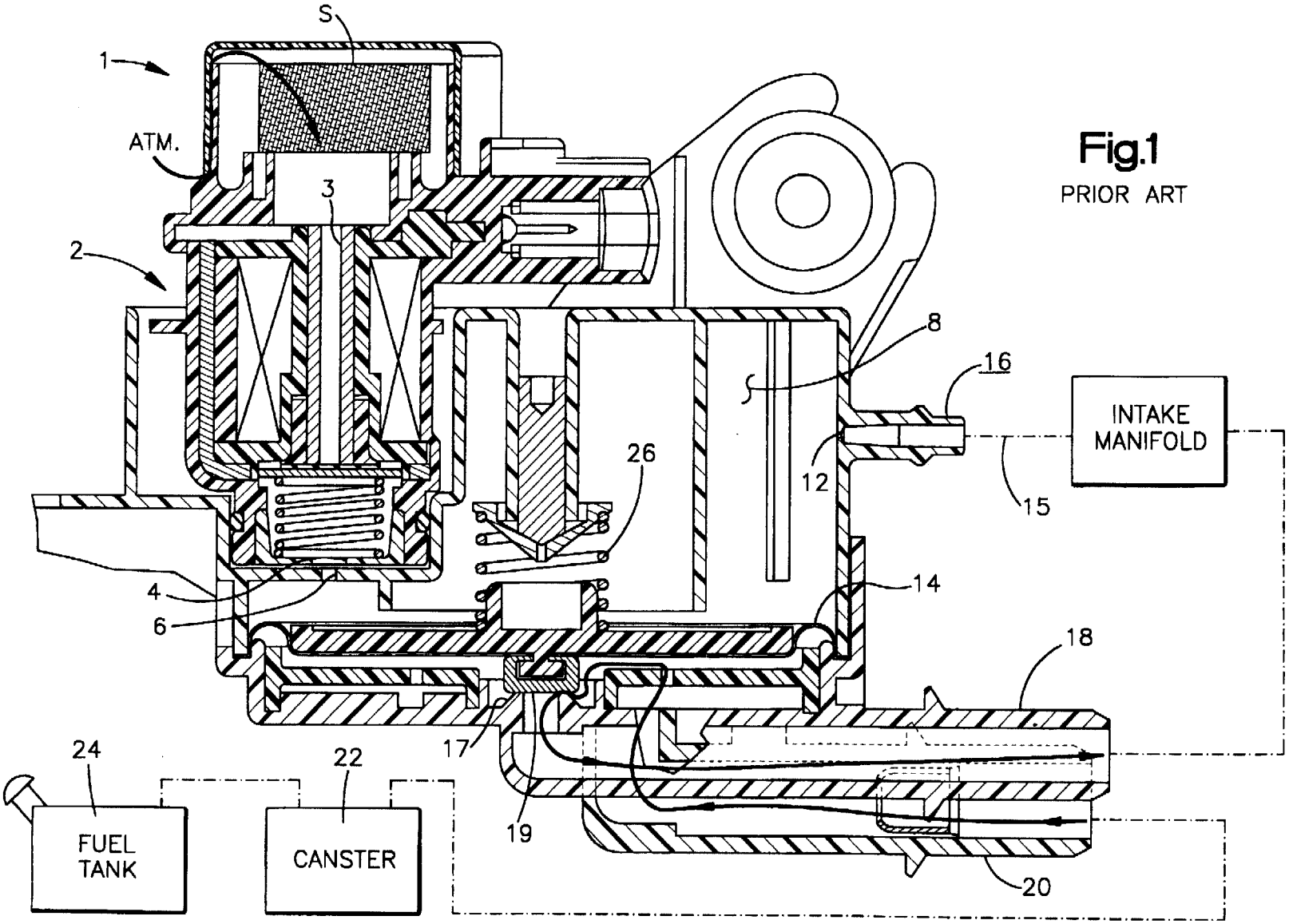
Fig.1 PRIOR ART
FIG. 1 is a cross-section of a prior art vapor management valve as connected to an engine intake manifold and fuel vapor canister.
Figure 2:
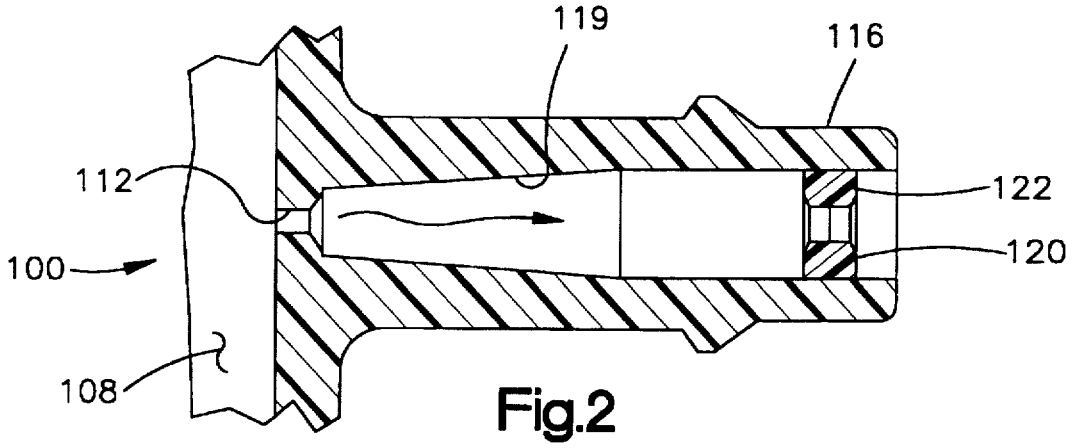
FIG. 2 is an enlarged view of a portion of FIG. 1 illustrating one embodiment of the modification of FIG. 1 in the present invention.

Referring to FIG. 2, the present invention is illustrated at 100 as comprising a VMV similar to FIG. 1 but having an inlet fitting illustrated at 116 and which has a modification to the prior art wherein the wall 108 of the vacuum signal pressure chamber is ported at 112 with a restricting orifice; and, the inlet passage in connector 116 has a second orifice 120 formed in the connector passage 119 and which is spaced from the orifice 112 and fluidically in series therewith. The orifice 120 may be formed in a suitable washer or insert 122 pressed into the passage 119. Preferably the downstream orifice 122 are sized to maintain the same pressure ratio thereacross as the upstream orifice 112. In the present practice of the invention, orifice 112 has a diameter of about 0.025 inches (0.63 mm) and downstream orifice of about 0.036 inches (0.91 mm) for the flow characteristics of FIG. 6.

Figure 6:
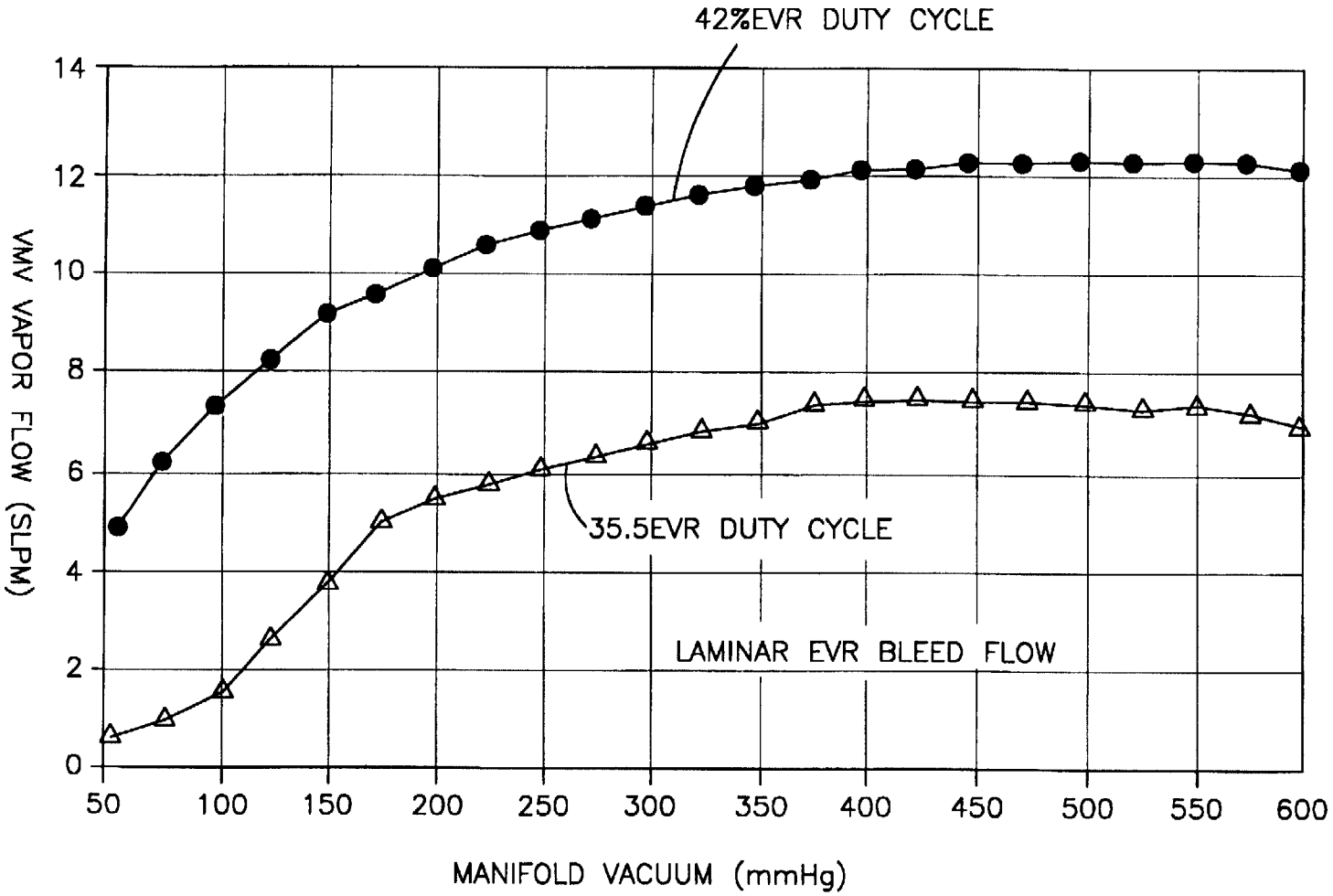

It will be understood that for fuel vapor flow characteristics other than as shown FIG. 6, orifices 112, 120 are sized differently to give the desired vacuum bleed flow; however, the two orifices function to prevent the occurrence of sonic flow choking.

Figure 4:
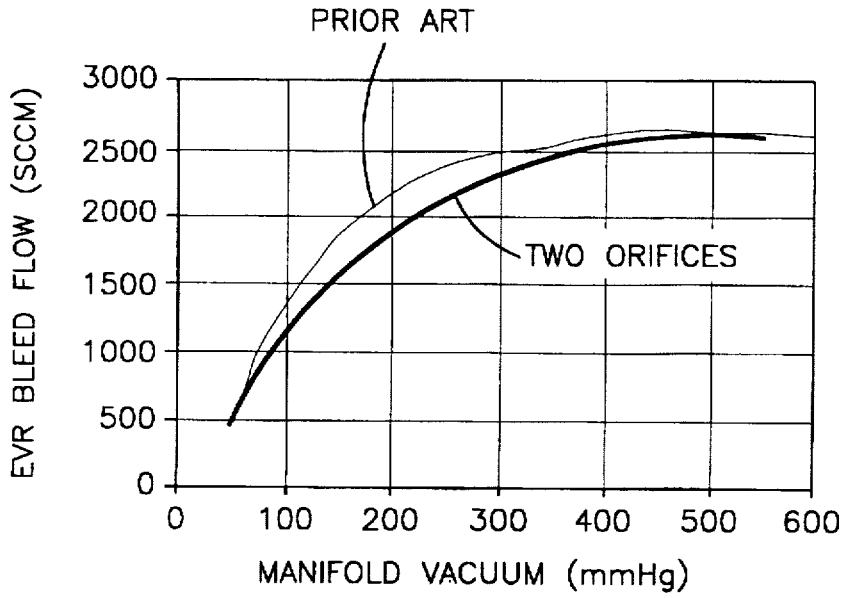
FIG. 4 is a graph plotting EVR bleed flow versus engine manifold vacuum for the prior art and the present invention.

Referring to FIG. 4, the EVR bleed flow through the atmospheric vent is shown plotted for the range of intake manifold vacuum encountered during engine operation, with the upper curve plotted for the prior art valve of FIG. 1 and the lower curve showing the flow as a function of intake manifold vacuum for the dual orifices of FIG. 2 for the present invention.

Figure 5:
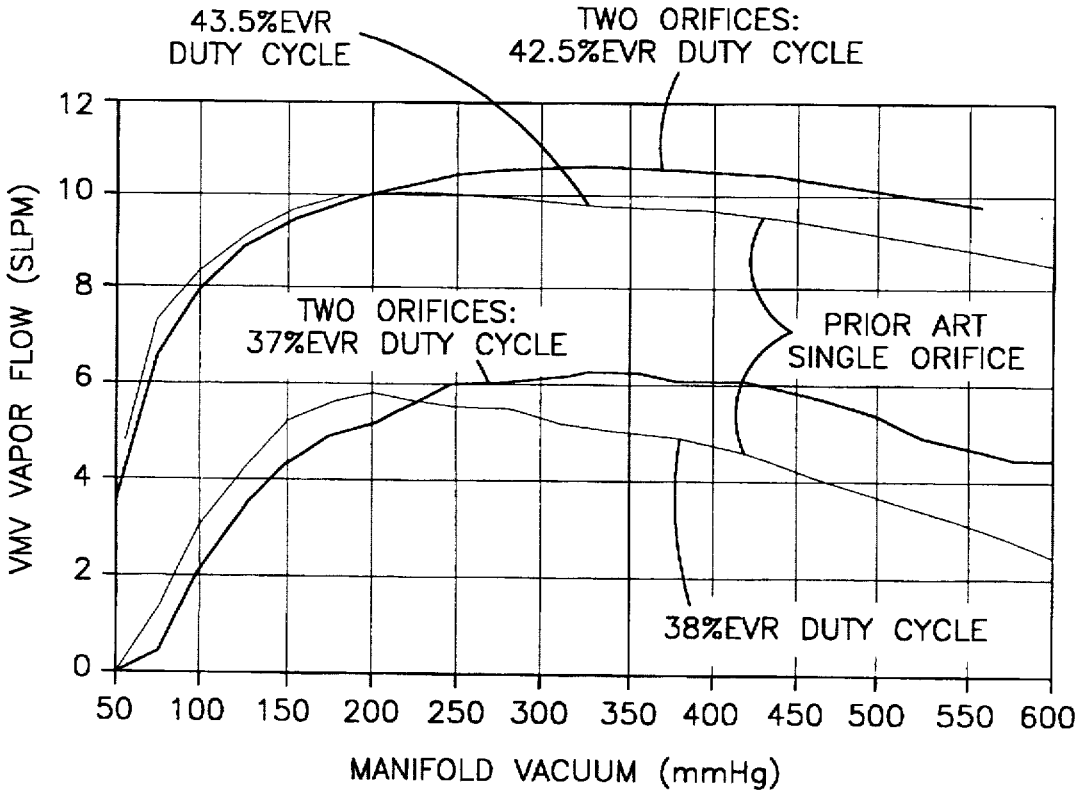
FIG. 5 is a graph showing VMV fuel vapor flow plotted as a function of manifold vacuum for the prior art and the present invention at different levels of duty cycle for the EVR electrical signal; and, FIG. 6 is a graph plotting VMV fuel vapor flow as a function of engine manifold vacuum of the present invention employing the laminar flow element for EVR bleed flow of FIG. 3 for two levels of EVR signal duty cycle.

Referring to FIG. 5, the vapor purge flow for the VMV is plotted as a function of engine intake manifold vacuum for the prior art valve of FIG. 1 and the flow for present invention as illustrated in FIG. 2. The upper set of flow curves in FIG. 5 was obtained with a 43.5% EVR electrical signal duty cycle for the prior art and a 42.5% EVR electrical signal duty cycle for the valve of the present invention. The lower set of curves in FIG. 5 was obtained for a 37% EVR electrical signal duty cycle for the two orifice arrangement of FIG. 2; and, a 38% EVR electrical signal duty cycle was utilized for the prior art valve of FIG. 1.

Figure 3:
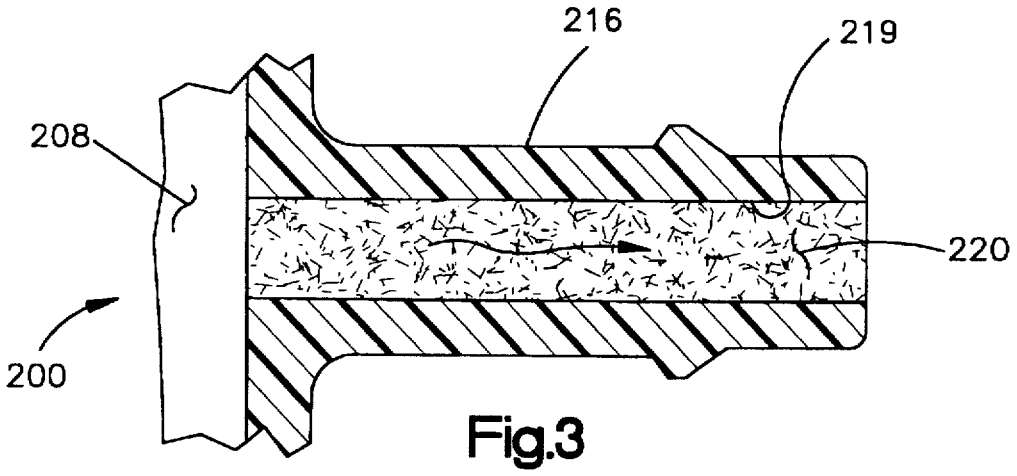
FIG. 3 is a view similar to FIG. 2 illustrating another embodiment of the present invention.

Referring to FIG. 6, the vapor purge flow of the VMV of the present invention as embodied in FIG. 3 is plotted as a function of engine intake manifold vacuum for two different percentage EVR electrical signal duty cycles namely 35.5% and 42% and illustrates the substantially constant vapor flow achieved at higher levels of engine intake manifold vacuum (lower manifold absolute pressure) achieved by the present invention.

Referring to FIG. 3, an alternative arrangement of the invention is illustrated generally at 200 in which the vacuum inlet fitting 216 has the flow passage 219 thereof filled with fluidically parallel laminar flow passages formed in a laminar flow element comprising a porous filter denoted by reference numeral 220 which may comprise fibrous material or alternatively porous sintered metal, or other suitable material. Filter 220 provides communication with the vacuum pressure signal chamber 208, it being understood that the remaining portions of the VMV of FIG. 3 are identical to those of the prior art valve of FIG. 1.

Figure 7:
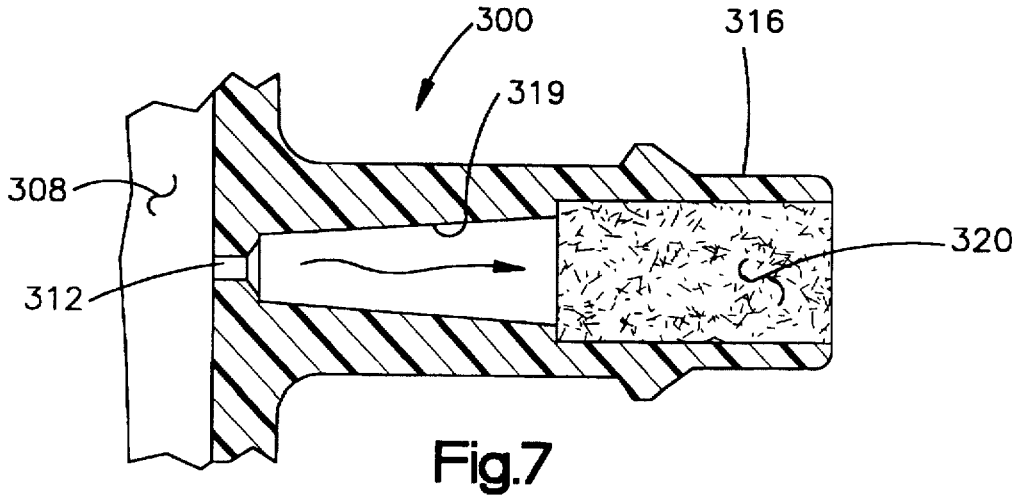
FIG. 7 is a view similar to FIG. 3 illustrating another embodiment of the invention.

Referring to FIG. 7, another embodiment of the invention is illustrated and indicated generally at 300 and has the vacuum signal control pressure chamber 308 communicating via orifice 312 with a flow passage 319 formed in vacuum inlet connector 316 which, it will be understood, is adapted for connection to the engine intake manifold by a suitable hose (not shown) but which connection is indicated by dashed outline and reference numeral 15 in FIG. 1. Passage 319 has received adjacent the end remote from orifice 312 a laminar flow element 320 which may be of the same material as the flow element 220 in the embodiment of FIG. 3. The element 320 in the embodiment of FIG. 7 is thus spaced along the passage 319 from the orifice 312.

In the present practice of the invention the filter material 220, 320 in the embodiments of FIG. 3 and FIG. 7 is high density polyethylene (HDPE) material having a 65 micron pore size, fifty percent (50%) pore volume. It will be understood that the flow through the elements 220, 320 is substantially laminar due to the small diameter of the pores; and, the pressure drop through the filter is approximately a linear function of flow and the pressure drop is a function of the filter area and filter length.

The embodiment of FIG. 7 thus combines an orifice and a laminar flow clement in series. This enables the flow to be tailored thereby minimizing the flow change upon a sudden change of the vacuum applied to the vacuum inlet connector.

Figure 8:
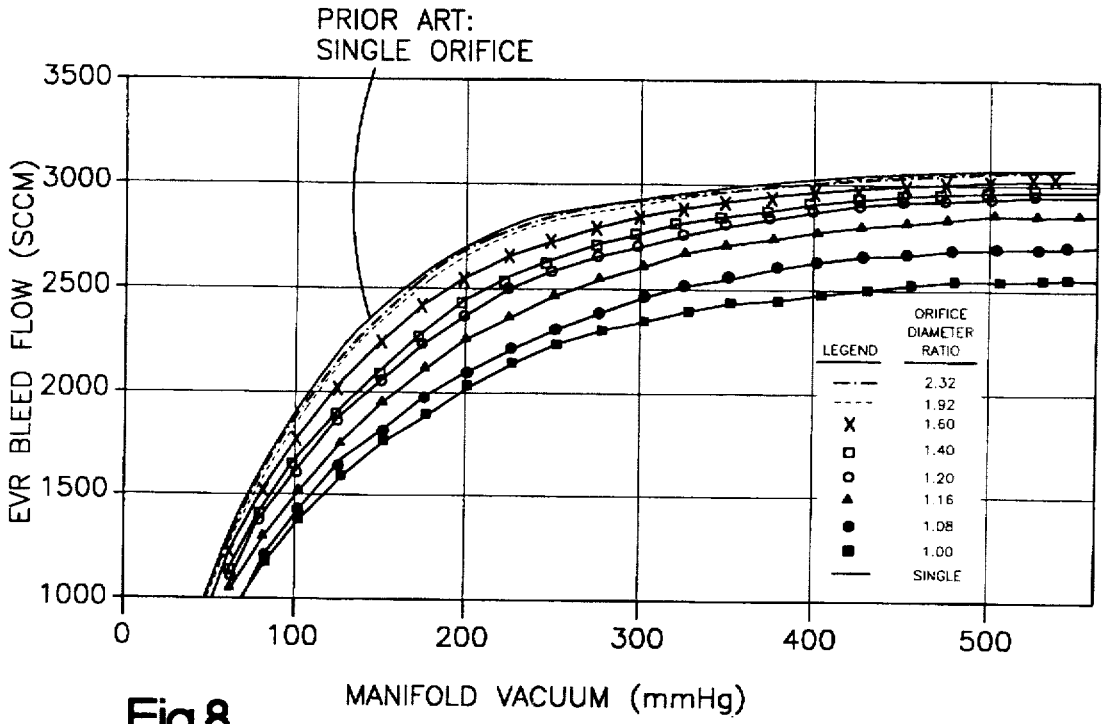
FIG. 8 is a graph plotting EVR bleed flow as a function of engine manifold vacuum for a family of orifices for the embodiment of FIG. 2.

Referring to FIG. 8, the EVR bleed flow through the dual orifices 112, 122 of the embodiment of FIG. 2 is plotted as a function of engine intake manifold vacuum. A family of curves are plotted for different ratios of the diameter of the orifice 122 to the diameter of orifice 112 over the range of manifold vacuum encountered during engine service. It will be apparent from FIG. 8 that the curves drawn through the data for the dual orifice configuration of FIG. 2, as compared with solid line curve the prior art single orifice, show a dramatic change in the EVR bleed flow with the present invention, particularly in the range of manifold vacuums of greatest concern namely, 200 through 500 millimeters HG manifold vacuum.

Figure 9:
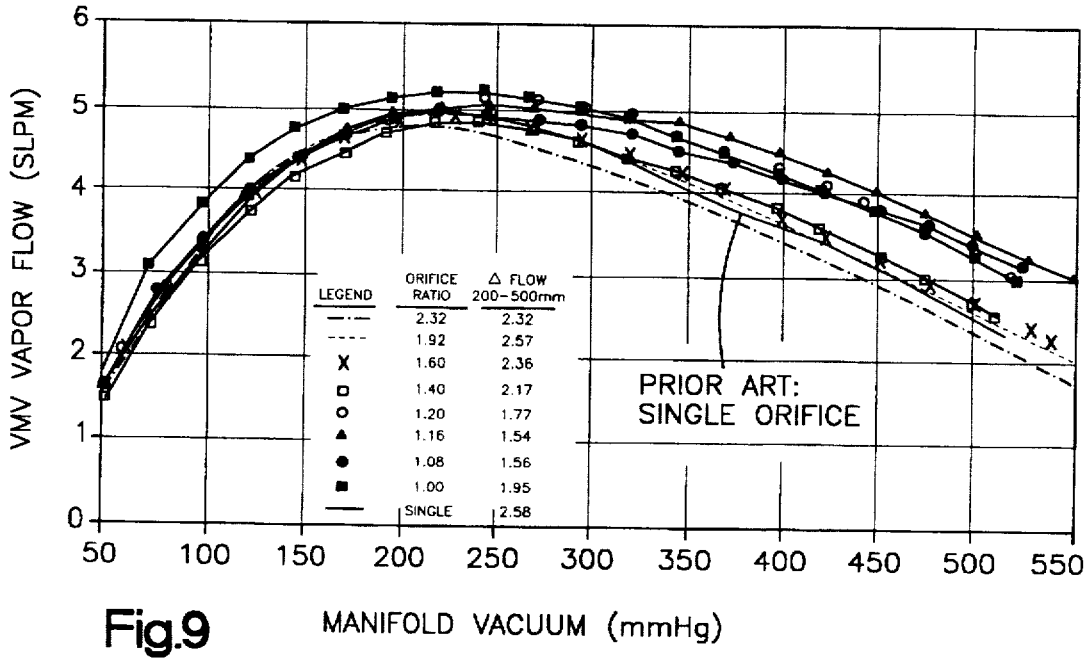
FIG. 9 is a graph plotting fuel vapor flow through the VMV regulator as a function of manifold vacuum.

Referring to FIG. 9 a family of graphs are plotted for the fuel vapor flow through the VMV to the intake manifold (through connectors 116, 216, 316) for different values of the ratio of orifice 122 to orifice 112. It will be seen from FIG. 9 that by appropriate sizing of the orifices 122, 112 significant improvement and changes in the characteristics of the fuel vapor flow may be obtained as compared to the solid line curve for the prior art configuration.

Figure 10:
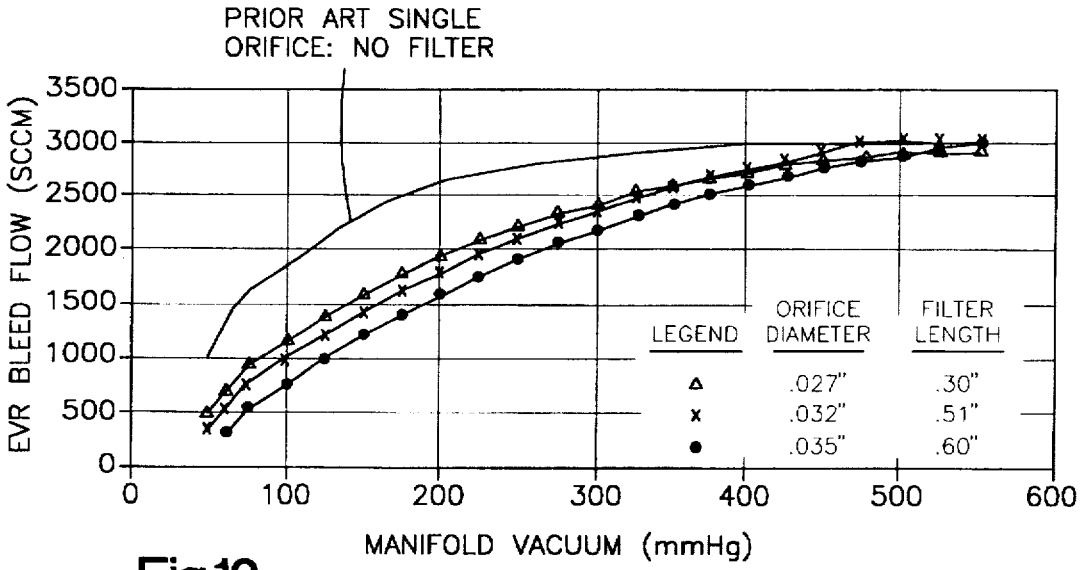
FIG. 10 is a graph plotting EVR bleed flow as a function of engine manifold vacuum for a family of orifices and filter lengths for the embodiment of FIG. 7; and, FIG. 11 is a graph plotting VMV fuel vapor flow as a function of engine manifold vacuum for a family of orifices and filter lengths for the embodiment of FIG. 7.

Referring to FIG. 10, a graph plotting the EVR bleed flow as a function of engine intake manifold vacuum is illustrated for the prior art single orifice construction of FIG. 1; and curves are plotted for data taken utilizing the single orifice in combination with laminar flow element embodiment of FIG. 7. The three curves drawn through the data taken for various orifice diameters show a dramatic linearization of the EVR bleed flow as compared with the curve for the prior art single orifice arrangement of FIG. 1, particularly in the range 200 to 500 mm Hg manifold vacuum.

Figure 11:
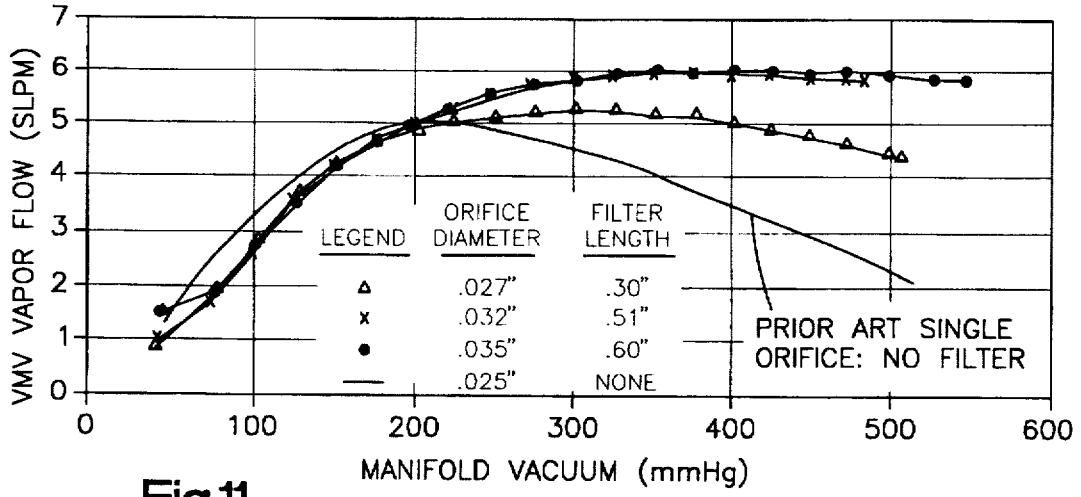

Referring to FIG. 11, the fuel vapor flow to the intake manifold through connector 316 of FIG. 7 is shown for a family of curves drawn through the data plotted for vapor flow as a function of engine manifold vacuum. It will be seen that the combination orifice and filter embodiment of FIG. 7 produces dramatic leveling of the fuel vapor flow over the engine manifold vacuum range of 200 through 500 millimeters HG as compared with the prior art construction of FIG. 1.

The present invention thus provides a simple and low cost technique for modifying an existing vapor management valve to prevent the occurrence sonic flow choking in the vacuum signal port which would restrict bleed flow therethrough from tracking engine manifold vacuum level changes. The present invention thus provides substantially constant vapor flow through the VMV at high levels of engine manifold vacuum (low manifold absolute pressure) particularly at "tip-out" because sonic choking of vacuum signal bleed flow to the signal pressure chamber is prevented.

Although the invention has hereinabove been described with respect to the illustrated embodiments, it will be understood that the invention is capable of modification and variation and is limited only by the following claims.

We claim:

1. An electrically operated fuel vapor management valve (VMV) assembly comprising:

(a) housing structure having therein a pressure responsive member dividing said housing structure into a control signal pressure chamber and a vapor flow control chamber;

(b) means defining a vacuum signal port in said control signal pressure chamber including means for restricting bleed flow therethrough and an atmospheric bleed port in said control signal pressure chamber;

(c) said vapor flow control chamber having a vapor inlet port adapted for connection to a vapor storage device and a vapor outlet port adapted for connection to an engine inlet manifold;

(d) a valve member associated with said pressure responsive member and moveable therewith for controlling flow between said vapor inlet port and said vapor outlet port;

(e) an electrically operated bleed valve (EVR) operable upon electrical energization to control atmospheric bleed flow through said bleed port; and, (f) said means restricting bleed flow includes a plurality of restrictive passages sized and disposed in spaced arrangement to prevent sonic flow choking through said vacuum signal source port, wherein said vacuum signal port is adapted for connection to an engine inlet manifold.

2. The assembly defined in claim 1, wherein said plurality of restrictive passages comprises a pair of spaced orifices disposed fluidically in series.

3. The assembly defined in claim 1, wherein said plurality of restrictive passages comprises a plurality of laminar flow passages disposed fluidically in parallel.

4. The assembly defined in claim 1, wherein said plurality of restrictive passages includes passages formed through a filter formed of fibrous material.

5. The assembly defined in claim 1, wherein said plurality of restrictive passages include passages through a porous sintered metal filter.

6. The assembly defined in claim 1, wherein said plurality of restrictive passages includes passages formed through fibrous filter material.

7. A method of controlling fuel vapor purge flow from a canister to an engine air inlet manifold comprising:

(a) forming a control pressure chamber on one side of a pressure responsive member and applying engine inlet manifold vacuum to said chamber and drawing a vacuum therein;

(b) porting said pressure chamber to the atmosphere and electrically controlling atmospheric air bleed to said chamber;

(c) disposing a moveable valve member in a valving chamber and connecting said valving chamber to said canister and to said engine air inlet manifold;

(d) connecting said moveable member to said pressure responsive member and moving said valve member and controlling vapor flow in said valving chamber to said engine air inlet; and, (e) said drawing a vacuum including drawing vacuum through a plurality of restricting passages in said vacuum port and restricting air flow therein and preventing sonic flow limiting therethrough.

8. The method defined in claim 7, wherein said step of drawing a vacuum includes disposing a first and second orifice fluidically in series.

9. The method defined in claim 7, wherein said step of drawing a vacuum includes disposing a fibrous filter material in said vacuum port.

10. The method defined in claim 7, wherein said step of drawing a vacuum includes disposing a plurality of laminar flow passages fluidically in parallel.

11. The method defined in claim 7, wherein said step of drawing a vacuum includes disposing a laminar flow element fluidically in series with a restricting orifice.

* * * * *